US010934924B1

(12) United States Patent
Park et al.

(10) Patent No.: US 10,934,924 B1
(45) Date of Patent: Mar. 2, 2021

(54) VEHICLE THERMAL MANAGEMENT SYSTEM APPLYING AN INTEGRATED THERMAL MANAGEMENT VALVE AND A COOLING CIRCUIT CONTROL METHOD THEREOF

(71) Applicants: HYUNDAI MOTOR COMPANY, Seoul (KR); KIA MOTORS CORPORATION, Seoul (KR)

(72) Inventors: Cheol-Soo Park, Yongin-si (KR); Bong-Sang Lee, Seongnam-si (KR); Dae-Kwang Kim, Yongin-si (KR); Dong-Suk Chae, Seoul (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/816,858

(22) Filed: Mar. 12, 2020

(30) Foreign Application Priority Data

Oct. 25, 2019 (KR) ..... 10-2019-0133840

(51) Int. Cl.

| | |
|---|---|
| ***F01P 7/14*** | (2006.01) |
| ***F01P 3/02*** | (2006.01) |
| ***F01P 5/10*** | (2006.01) |
| ***F02M 26/22*** | (2016.01) |
| ***F01P 3/18*** | (2006.01) |
| ***F01P 11/04*** | (2006.01) |

(52) U.S. Cl.
CPC ..... *F01P 7/14* (2013.01); *F01P 3/02* (2013.01); *F01P 3/18* (2013.01); *F01P 5/10* (2013.01); *F01P 11/04* (2013.01); *F02M 26/22* (2016.02); *F01P 2003/021* (2013.01); *F01P 2003/024* (2013.01); *F01P 2003/027* (2013.01); *F01P 2003/028* (2013.01); *F01P 2007/146* (2013.01); *F01P 2060/08* (2013.01)

(58) Field of Classification Search
CPC ..... F01P 2007/146; F01P 3/20; F01P 7/165; F01P 3/02; F01P 2060/00; F01P 3/12
See application file for complete search history.

(56) References Cited

U.S. PATENT DOCUMENTS 6,668,764 B1 * 12/2003 Henderson ..... F01P 7/167 123/41.1
9,188,051 B1 11/2015 Zahdeh
(Continued)

FOREIGN PATENT DOCUMENTS

JP 2013024110 A 2/2013

*Primary Examiner* — Long T Tran
(74) *Attorney, Agent, or Firm* — Lempia Summerfield Katz LLC

(57) ABSTRACT

A vehicle thermal management system includes an Integrated Thermal Management Valve (ITM) for receiving engine coolant through a coolant inlet connected to an engine coolant outlet of an engine, and for distributing the engine coolant flowing out toward a radiator through a coolant outlet flow path connected to a heater core and a radiator. The thermal management system includes a water pump positioned at the front end of an engine coolant inlet of the engine, a coolant branch flow path branched at the front end of the engine coolant inlet to be connected with an Exhaust Gas Recirculation (EGR) cooler. and a Smart Single Valve (SSV) for adjusting an engine coolant flow in the EGR cooler flow path direction on the coolant branch flow path.

13 Claims, 7 Drawing Sheets

(56) References Cited

U.S. PATENT DOCUMENTS

| | | | | |
|---|---|---|---|---|
| 9,649,909 | B2 | 5/2017 | Enomoto | |
| 10,161,292 | B1 | 12/2018 | Park | |
| 10,227,910 | B2 | 3/2019 | Kaneko | |
| 10,232,702 | B2 | 3/2019 | Nishikawa | |
| 10,279,656 | B2 | 5/2019 | Quix | |
| 2005/0000473 | A1 | 1/2005 | Ap | |
| 2006/0185364 | A1 | 8/2006 | Chalgren | |
| 2011/0023796 | A1 | 2/2011 | Cattani | |
| 2012/0067545 | A1* | 3/2012 | Yamazaki | F01M 5/00 165/52 |
| 2012/0111956 | A1 | 5/2012 | Kinomura | |
| 2012/0160447 | A1* | 6/2012 | Kinomura | F01P 11/20 165/51 |
| 2013/0213324 | A1* | 8/2013 | Saitoh | F01P 7/165 123/41.09 |
| 2013/0213600 | A1* | 8/2013 | Saitoh | F01P 7/16 165/11.1 |
| 2013/0243600 | A1 | 9/2013 | Noble | |
| 2013/0305708 | A1* | 11/2013 | Zahdeh | F01P 3/20 60/599 |
| 2015/0159540 | A1 | 6/2015 | Misumi | |
| 2016/0003127 | A1 | 1/2016 | Sakagawa | |
| 2016/0084142 | A1 | 3/2016 | Gooden | |
| 2016/0169081 | A1* | 6/2016 | Hosokawa | F01P 7/16 123/41.08 |
| 2016/0258341 | A1 | 9/2016 | Yoon | |
| 2016/0258343 | A1 | 9/2016 | Mushiga | |
| 2016/0341100 | A1 | 11/2016 | Nagai | |
| 2016/0348568 | A1* | 12/2016 | Kanefsky | F01P 5/12 |
| 2017/0074152 | A1 | 3/2017 | Woo | |
| 2017/0074154 | A1 | 3/2017 | Kaneko | |
| 2017/0159545 | A1* | 6/2017 | Onishi | B60H 1/32281 |
| 2017/0184008 | A1 | 6/2017 | Nagai | |
| 2017/0298860 | A1 | 10/2017 | Mori | |
| 2017/0361698 | A1* | 12/2017 | Hussain | F01P 1/06 |
| 2017/0370271 | A1 | 12/2017 | Lee | |
| 2017/0370272 | A1 | 12/2017 | Koguchi | |
| 2018/0230893 | A1 | 8/2018 | Sato | |
| 2018/0298806 | A1 | 10/2018 | Sutherland | |
| 2018/0347445 | A1 | 12/2018 | Kaneko | |
| 2019/0010857 | A1 | 1/2019 | Kaneko | |
| 2019/0093546 | A1* | 3/2019 | Takagi | F01P 7/164 |
| 2019/0120178 | A1* | 4/2019 | Park | F02D 41/0077 |
| 2019/0152343 | A1 | 5/2019 | Onozawa | |
| 2019/0178148 | A1 | 6/2019 | Yi | |
| 2019/0186497 | A1* | 6/2019 | Lee | F04D 27/003 |

* cited by examiner

VEHICLE THERMAL MANAGEMENT SYSTEM APPLYING AN INTEGRATED THERMAL MANAGEMENT VALVE AND A COOLING CIRCUIT CONTROL METHOD THEREOF

CROSS-REFERENCE TO RELATED APPLICATION

This application claims priority to Korean Patent Application No. 10-2019-0133840, filed on Oct. 25, 2019, which is incorporated herein by reference in its entirety.

BACKGROUND OF THE DISCLOSURE

Field of the Disclosure

The present disclosure relates to a vehicle thermal management system, and more particularly, to a cooling circuit control of a vehicle thermal management system. The vehicle thermal management system may control the flow rate of engine coolant at an EGR cooler side by a smart control valve in addition to a variable separation cooling control of an integrated thermal management valve, thereby improving the fast warm-up and heating performance of an engine while shortening the EGR usage time point capable of improving fuel efficiency.

Description of Related Art

In general, simultaneously satisfying both high fuel efficiency and high performance is a representative trade-off problem of the fuel efficiency-performance of gasoline-diesel vehicles. One method for solving the trade-off problem is, for example, to improve the performance of a Vehicle Thermal Management System (VTMS).

The reason to solve the trade-off problem by improving the VTMS performance is because the VTMS may be constructed to associate an engine cooling system, an Exhaust Gas Recirculation (EGR) system, an Auto Transmission Fluid (ATF) system, and a heater system with an engine. The VTMS may effectively distribute and control the high temperature coolant of the engine transmitted to each of the systems according to the vehicle or the engine operating condition, thereby simultaneously satisfying high fuel efficiency and high performance.

Therefore, the VTMS is a design factor in which the efficiency of an engine coolant distribution control is very important. To this end, some of a plurality of heat exchange systems associated with the engine maintains a high coolant temperature while others maintain a low coolant temperature, such that it is necessary to use an Integrated Thermal Management Valve (ITM, hereinafter referred to as ITM) for the coolant distribution control to efficiently control the plurality of heat exchange systems at the same time.

For example, the ITM has an inlet into which the engine coolant flows and has four ports so that the received engine coolant flows out in different directions. The cooling system, the Exhaust Gas Recirculation (EGR) system, the Auto Transmission Fluid (ATF) system, and the heater system may be associated in four ways by four ports, thereby optimizing the heat exchange effect of the engine coolant in which the temperature varies according to the operating state of the engine.

In this case, the cooling system may be a radiator for lowering the engine coolant temperature by exchanging heat with the outside air. The EGR system may be an EGR cooler for lowering the temperature of the EGR gas transmitted to the engine among the exhaust gas by exchanging heat with the engine coolant. The ATF system may be an oil warmer for raising the ATF temperature by exchanging heat with the engine coolant. The heater system may be a heater core for raising the outside air by exchanging heat with the engine coolant.

Furthermore, the ITM performs an ITM valve opening control by using a temperature detection value of a coolant temperature sensor provided at the coolant inlet/outlet sides of the engine in the respective coolant controls of the EGR cooler, the oil warmer, and the heater core, such that it is more effective to reduce the fuel consumption while enhancing the entire cooling efficiency of the engine.

The contents described in Description of Related Art are to help the understanding of the background of the present disclosure and may include what is not previously known to those of ordinary skill in the art to which the present disclosure pertains.

However, in recent years, fuel efficiency improvement demands that are further strengthened for gasoline/diesel vehicles require VTMS performance improvement, which leads to the performance improvement demand for an engine coolant distribution control of an ITM.

The reason for the performance improvement demand is because the ITM may further enhance the efficiency of the engine coolant distribution control by changing an ITM layout that connects an engine and a system.

For example, the ITM layout is more effective to be configured to firstly enable a variable flow pattern control of engine coolant in an engine, to secondly enable the position optimization of any one among the cooling/EGR/ATF/heater systems, and to thirdly enable the optimization of the exhaust heat recovery control performance.

SUMMARY OF THE DISCLOSURE

Therefore, an object of the present disclosure considering the above point is to provide a vehicle thermal management system that applies a layer ball type integrated thermal management valve and a cooling circuit control method thereof, which may apply a layer valve body to the integrated thermal management valve. Thereby, the ITM layout capable of a variable flow pattern control of the engine coolant in the engine, the optimal position selection of the engine-associated system, and the exhaust heat recovery optimal control are implemented. In particular, the vehicle thermal management system and the cooling circuit control method may control the flow rate of the engine coolant at the EGR cooler side in association with a Smart Single Valve (SSV) by the four-port ITM layout, thereby improving the fast warm-up and heating performance of the engine while improving fuel efficiency by shortening the EGR usage time point.

A vehicle thermal management system according to the present disclosure includes: an ITM for receiving engine coolant through a coolant inlet connected to an engine coolant outlet of an engine, and distributing the engine coolant flowing out toward a radiator through a coolant outlet flow path connected to a heater core and a radiator; a water pump positioned at the front end of an engine coolant inlet of the engine; a coolant branch flow path branched at the front end of the engine coolant inlet to be connected with an EGR cooler; and a SSV for adjusting an engine coolant flow in the EGR cooler flow path direction on the coolant branch flow path.

In an embodiment, the EGR cooler flow path direction may be an EGR coolant flow path through which the EGR cooler is installed and the SSV is joined.

In an embodiment, the coolant outlet flow path may include: a radiator outlet flow path connected to the radiator; a heater outlet flow path connected to the heater core; and an EGR outlet hole connected to the EGR cooler connected with the coolant branch flow path.

In an embodiment, the EGR outlet hole may be connected with the EGR coolant flow path of the EGR cooler.

In an embodiment, the engine coolant outlet may include an engine head coolant outlet and an engine block coolant outlet. The coolant inlet may include an engine head coolant inlet connected with the engine head coolant outlet and an engine block coolant inlet connected with the engine block coolant outlet.

In an embodiment, the valve opening of the ITM may form the opening or closing of the engine head coolant inlet and the engine block coolant inlet oppositely.

In an embodiment, the opening of the engine head coolant inlet may form a Parallel Flow, in which the coolant flows out to the engine head coolant outlet, inside an engine. The opening of the engine block coolant inlet may form a Cross Flow, in which the coolant flows out to the engine block coolant outlet, inside the engine.

Further, a cooling circuit control method of a vehicle thermal management system according to the present disclosure includes: distributing the coolant flowing out toward a heater core and a radiator by flowing the engine coolant circulated to a water pump and the radiator from an ITM into an engine; adjusting a coolant flow on the coolant branch flow path branched at the front end of the engine coolant inlet to be connected with an EGR cooler by a SSV; distributing the coolant by switching the outlet flow path of the coolant outlet flow path connected to the heater core to the ITM, and adjusting the coolant flow by switching the coolant branch flow path connected to an EGR outlet hole of the coolant outlet flow path connected to the EGR cooler to the SSV; and performing any one among a STATE 1, a STATE 2, a STATE 3, a STATE 4, and a STATE 5 as an engine coolant control mode of a vehicle thermal management system under a valve opening control of the ITM and the SSV by a valve controller.

In an embodiment, the valve controller may determine the operating condition with the vehicle operating information detected through the vehicle thermal management system. The operating condition may be applied to the transition condition for the STATE switching while determining the controlling of the STATE 1, the STATE 2, the STATE 3, the STATE 4, and the STATE 5.

In an embodiment, in the STATE 1, the ITM may open the engine head coolant inlet while it closes the engine block coolant inlet, the radiator outlet flow path, and the heater outlet flow path. The SSV may close the coolant branch flow path with respect to both an engine inlet and an engine outlet.

In an embodiment, in the STATE 2, the ITM may open the heater outlet flow path while opening the engine head coolant inlet while it closes the radiator outlet flow path while partially opening the engine block coolant inlet. The SSV may open the coolant branch flow path with respect to an engine outlet while closing it with respect to an engine inlet.

In an embodiment, in the STATE 3, the ITM may open the engine head coolant inlet and the heater outlet flow path while it closes the radiator outlet flow path while partially opening the engine block coolant inlet. The SSV may close the coolant branch flow path with respect to both an engine inlet and an engine outlet.

In an embodiment, in the STATE 4, the ITM may open the engine head coolant inlet and the heater outlet flow path while it partially opens the radiator outlet flow path while closing the engine block coolant inlet. The SSV may open the coolant branch flow path with respect to an engine inlet while closing it with respect to an engine outlet.

In an embodiment, in the STATE 5, the ITM may open the engine block coolant inlet, the radiator outlet flow path, and the heater outlet flow path while it closes the engine head coolant inlet. The SSV may open the coolant branch flow path with respect to an engine inlet while closing it with respect to an engine outlet.

In an embodiment, the valve controller may be switched to an engine coolant control mode that opens the valve opening of the ITM to a maximum cooling position at the engine stop.

Further, an integrated thermal management valve according to the present disclosure flows in and out engine coolant flowing out from an engine by the rotation of first and second layer balls inside a valve housing. The valve housing includes: a housing heater port forming a heater outlet flow path flowing out the engine coolant to a heater core side; an EGR outlet hole flowing out to an EGR cooler side; and a radiator port forming a first direction flow path flowing out to a radiator side.

In an embodiment, the first layer ball may flow the engine coolant from the inside of the valve housing to the outside thereof. The second layer ball may flow the engine coolant from the outside of the valve housing to the inside thereof.

In an embodiment, the first layer ball may form a channel flow path communicated with the heater port and the radiator outlet. The channel flow path may be formed in the shape having one end tapered toward the channel end.

In an embodiment, the second layer ball may form a head flow path in the head direction through an engine head coolant inlet connected to an engine head coolant outlet of the engine, and a block flow path in the block direction through an engine block coolant inlet connected to an engine block coolant outlet of the engine, and the opening and closing of the head directional flow path and the block directional flow path are formed oppositely from each other.

In an embodiment, the first layer ball and the second layer ball may be rotated by an actuator to form an engine coolant control mode by an ITM valve opening control. The engine coolant control mode may be implemented by performing the ITM valve opening control by the valve controller that uses, as input data, the engine coolant temperature outside the engine detected by a first WTS, and the engine coolant temperature inside the engine detected by a second WTS.

The present disclosure has the following advantages by improving the integrated thermal management valve and the vehicle thermal management system at the same time.

For example, the operations and effects that occur in the integrated thermal management valve are described below. First, it is possible to implement the engine coolant distribution control effect as it is even while reducing the existing coolant flow in/out ports (for example, reducing from four ports to three ports) by changing the number of the two layer balls having a cylindrical structure. Second, it is possible to simplify the structure due to the reduction in the number of the ports. Third, it is possible to simplify the valve structure, thereby saving in costs.

For example, the operations and effects that occur in the vehicle thermal management system when applying the 2-layer ITM layout of the layer ball type integrated thermal management valve are described below. First, it is possible: to improve the fuel efficiency in the normal load condition by performing the variable flow pattern control in the engine in the Parallel Flow, in which the cylinder block temperature is raised to be an advantage for friction improvement; to improve the knocking in the high load condition in the Cross Flow, in which the cylinder block temperature is lowered; and to improve the performance/fuel efficiency/durability at the same time by improving the knocking and improving the friction. Second, it is possible to control the flow rate of the engine coolant at the EGR cooler in association with the ITM and the SSV, thereby improving the EGR condensate problem at the initial start of the engine, and in particular, to reduce the EGR temperature by securing the flow rate of the EGR cooler after the warm-up while shortening the EGR usage time point to lower the intake air temperature, thereby additionally improving fuel efficiency and performance Third, it is possible to improve the heating performance and implement the fast warm-up to enable the fast warm-up of the coolant/engine oil/transmission oil, thereby also enhancing the merchantability of the vehicle through the grade improvement displayed in the fuel efficiency label (for example, indication of the energy consumption efficiency grade).

DESCRIPTION OF SPECIFIC EMBODIMENTS

Hereinafter, various embodiments of the present disclosure are described below in detail with reference to the accompanying drawings. Since these embodiments may be implemented by those of ordinary skill in the art to which the present disclosure pertains in various different forms, they are not limited to the embodiment described herein.

Figure 1:
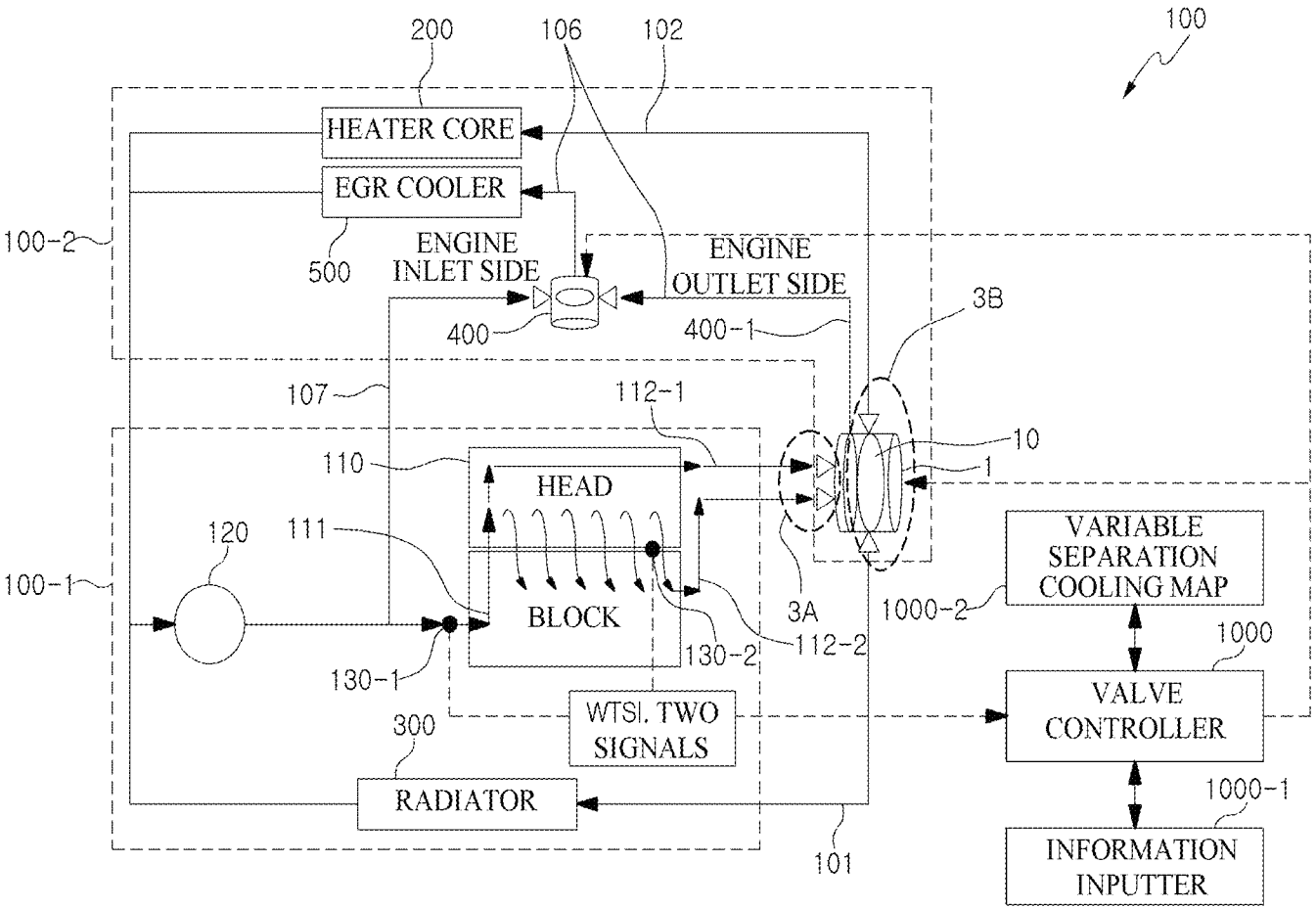
FIG. 1 is a diagram illustrating an example of a vehicle thermal management system applying a 2-layer ball type integrated thermal management valve according to the present disclosure.

Referring to FIG. 1, a Vehicle Thermal Management System (hereinafter referred to as VTMS) 100 includes: a 2-layer type Integrated Thermal Management Valve (hereinafter referred to as ITM) 1; a coolant circulation system 100-1 for adjusting the temperature of engine coolant; a coolant distribution system 100-2 composed of a heat exchange system; a Smart Single Valve 400 for adjusting a coolant flow distributed from the ITM 1; an EGR cooler 500 for controlling the temperature of the EGR gas transmitted to an engine of exhaust gas; and a valve controller 1000.

In particular, the vehicle thermal management system 100 installs the EGR cooler 500 at the front end of the engine, and is joined with the engine coolant branched from the front end of the engine (i.e., the outlet end side of the water pump) or is joined with the engine coolant branched from the rear end of the engine (i.e., an EGR outlet hole 3B-3 of the ITM 1 (see FIG. 2)) in the valve opening direction of the SSV 400.

To this end, the EGR cooler 500 is associated with the SSV 400, which is installed on an EGR coolant flow path 106 connected with an EGR outlet hole 3B-3 of the ITM 1 (see FIG. 2) and is opened by using the EGR coolant flow path 106 as an engine outlet side port communicated with the EGR outlet hole 3B-3 and using the coolant branch flow path 107 connected to the water pump outlet end of the water pump 120 as an engine inlet side port of the front end of the engine, to receive the flow rate of the coolant required at the initial operation of the engine 110 with a small amount of engine coolant flowing out from the water pump outlet end at the initial state of the SSV 400. In this case, the EGR coolant flow path 106 is joined with the first coolant flow path 101 at the front end of the water pump 120 constituting the coolant circulation system 100-1 to be formed as one line.

Further, if the valve opening of the SSV 400 is switched from the opening of the engine inlet side port to the opening of the engine outlet side port, the EGR cooler 500 shortens the EGR usage time point to be advantageous for improving fuel efficiency at the warm-up while if it is switched from the opening of the engine outlet side port to the opening of the engine inlet side port, the EGR cooler 500 secures the flow rate of the EGR cooler 500 after the warm-up and strengthens the EGR cooling by supplying low coolant to reduce the EGR temperature and reduce the intake air temperature. Thereby, fuel efficiency and performance are improved.

Therefore, the vehicle thermal management system 100 may control the flow rate of the engine coolant at the EGR cooler 500 side under the associated control of the ITM 1 and the SSV 400 before and after the warm-up of the engine 110. Thereby, the EGR usage time point capable of improving fuel efficiency is shortened and the heating performance of the heater core 200 applied as the heat exchange system is improved while simultaneously implementing the fast warm-up of the engine/engine oil/ATF oil.

The coolant described below refers to an engine coolant.

Specifically, the ITM 1 enhances the heat exchange efficiency together with the fast mode switching of coolant control modes (for example, STATES 1-5) of the vehicle heat management system 100 in the opening direction of the SSV 400 associated with the ITM 1 even while performing all functions implemented by the existing four-port ITM by a variable separation cooling operation by a three-port combination of a first layer ball 10A and a second layer ball 10B constituting a layer ball 10.

Specifically, the engine 110 is a gasoline engine. The engine 110 forms an engine coolant inlet 111 into which coolant flows and an engine head coolant outlet 112-1 and an engine block coolant outlet 112-2 out which the coolant flows. The engine coolant inlet 111 is connected to a water pump 120 by the first coolant flow path 101 of the engine cooling system 100-1. The engine head coolant outlet 112-1 is formed at an engine head that includes a cam shaft, a valve system, and the like to be connected with an engine head coolant inlet 3A-1 of the ITM 1. The engine block coolant outlet 112-2 is formed at an engine block that includes a cylinder, a piston, a crankshaft, and the like to be connected with the engine block coolant inlet 3A-2 of the ITM 1.

Further, the engine 110 includes a first Water Temperature Sensor (WTS) 130-1 and a second Water Temperature Sensor (WTS) 130-2. The first WTS 130-1 detects the temperature of the engine coolant inlet 111 side of the engine 110. The second WTS 130-2 detects the temperature of the engine coolant outlet 112 side of the engine 110, respectively to transmit them to the valve controller 1000.

Specifically, the coolant circulation system 100-1 is composed of a water pump 120 and a radiator 300 and forms a coolant circulation flow of the engine 110 by the first coolant flow path 101. Further, the coolant circulation system 100-1 is associated with the EGR cooler 500 by connecting the coolant branch flow path 107 to the water pump outlet end of the water pump 120.

For example, the water pump 120 pumps the engine coolant to form the coolant circulation flow. To this end, the water pump 120 applies a mechanic water pump connected with the crankshaft of the block by a belt or a chain to pump the engine coolant to the block side of the engine 110 or applies an electronic water pump that operates by a control signal of an Electronic Control Unit (ECU). The radiator 300 cools the high temperature coolant flowing out from the engine 110 by exchanging heat with the air.

In particular, the first coolant flow path 101 is connected to the radiator outlet flow path 3B-1 of the coolant outlet flow path 3B of the ITM 1 (see FIG. 2) so that the coolant flowing out from the ITM 1 is distributed.

Specifically, the coolant distribution system 100-2 forms the coolant circulation flow by the second coolant flow path 102 that associates with the ITM 1 by using, as a heat exchange system, the heater core 200 that raises the outside air temperature by exchanging heat with the engine coolant. In this case, the second coolant flow path 102 is arranged in parallel with the first coolant flow path 101. Further, the second coolant flow path 102 is formed in one line by being joined with the first coolant flow path 101 at the front end of the water pump 120. In particular, the heater core 200 is connected in parallel with the EGR cooler 500.

In particular, the second coolant flow path 102 is connected with the heater outlet flow path 3B-2 of the coolant outlet flow path 3B of the ITM 1 (see FIG. 2) to form the coolant circulation flow by the coolant distribution using a different path from the radiator outlet flow path 3B-1.

Therefore, the coolant distribution system 100-2 receives the coolant by the heater outlet flow path 3B-2 of the ITM 1 to circulate it in the second coolant flow path 102.

Specifically, the SSV 400 receives the engine coolant flowing out from the water pump 120 at the front end of the engine by using the opening direction of the coolant branch line 107 as the engine inlet side port to join it in the EGR cooler 500 or transmits the flow rate of the engine coolant flowing out from the engine outlet side through the ITM 1 by using the opening direction of the coolant branch line 107 as the engine outlet side port according to the valve opening by the rotation of an SSV valve body embedded in an SSV housing. In this case, the SSV 400 is formed as the initial state of the SSV 400, which is opened slightly so that the EGR coolant flow path 106 and the coolant branch line 107 are communicated with the front end of the engine in order to flow a small amount of flow rate of the coolant required at the initial start of the engine 110 to the EGR cooler 500. In this example, the initial opening state of the SSV 400 is the same as the size of a leak hole that flows a small amount of coolant for improving the temperature sensitivity at the initial start of the EGR cooler 500. Further, the opening direction switching of the coolant branch line 107 by the valve opening of the SSV 400 classifies an SSV operating mode into B, C, D, and E.

In particular, the SSV 400 is configured symmetrically with respect to the section where two ports (i.e., the engine inlet side port and the engine outlet side port) are completely closed or slightly opened with respect to the opening/closing of the coolant branch line 107. In other words, the SSV 400 is composed of the section where only the engine outlet side and inlet side are opened by 0 to 100% and the section where the opposite port is slightly opened in a state where one side port is opened by 100%.

For example, the SSV 400 forms an inner space in which the engine coolant bypassed to the SSV housing flows in and out, and the SSV valve body accommodated in the inner space of the SSV housing is controlled by the valve controller 1000 to form the opening of the SSV valve. To this end, the SSV 400 is composed of a 2-way variable flow rate control valve.

Specifically, the valve controller 1000 optionally forms the coolant flow of the first coolant flow path 101 circulating the radiator 300 of the coolant circulation system 100-1, and the coolant flow of the second coolant flow path 102 circulating the heater core 200 of the coolant distribution system 100-2 under the valve opening control of the ITM 1, and the coolant flow of the EGR coolant flow path 106 through the engine outlet side port circulating the EGR cooler 500 under the valve opening control of the SSV 400 and the coolant joining flow of the coolant branch flow path 107 receiving the engine coolant flowing out from the water pump 120 at the front end of the engine to transmit it to the EGR cooler 500 under the valve opening control of the SSV 400.

To this end, the valve controller 1000 shares the information of the engine controller (for example, the information inputter 1000-1) for controlling the engine system via CAN, and receives temperature detection values of first and second WTSs 130-1, 130-2 to control the valve opening of the ITM 1 and the SSV 400, respectively. In particular, the valve controller 1000 has a memory in which logic or a program matching the coolant control mode (for example, STATES 1-5) has been stored, and outputs the valve opening signals of the ITM 1 and the SSV 400.

Further, the valve controller 1000 has the information inputter 1000-1, and a variable separation cooling map 1000-2 provided with an ITM map that matches the valve opening of the ITM 1 to the engine coolant temperature condition and the operating condition according to the vehicle information and a SSV map that matches the valve opening of the SSV 400 to the engine coolant temperature condition and the operating condition according to the vehicle information.

In particular, the information inputter 1000-1 detects an IG on/off signal, a vehicle speed, an engine load, an engine temperature, a coolant temperature, a transmission fluid temperature, an outside air temperature, an ITM operating signal, accelerator/brake pedal signals, and the like to provide them as input data of the valve controller 1000. In this case, the vehicle speed, the engine load, the engine temperature, the coolant temperature, the transmission fluid temperature, the outside air temperature, and the like are applied as the operating conditions. Therefore, the information inputter 1000-1 may be an engine controller for controlling the entire engine system.

Figure 2:
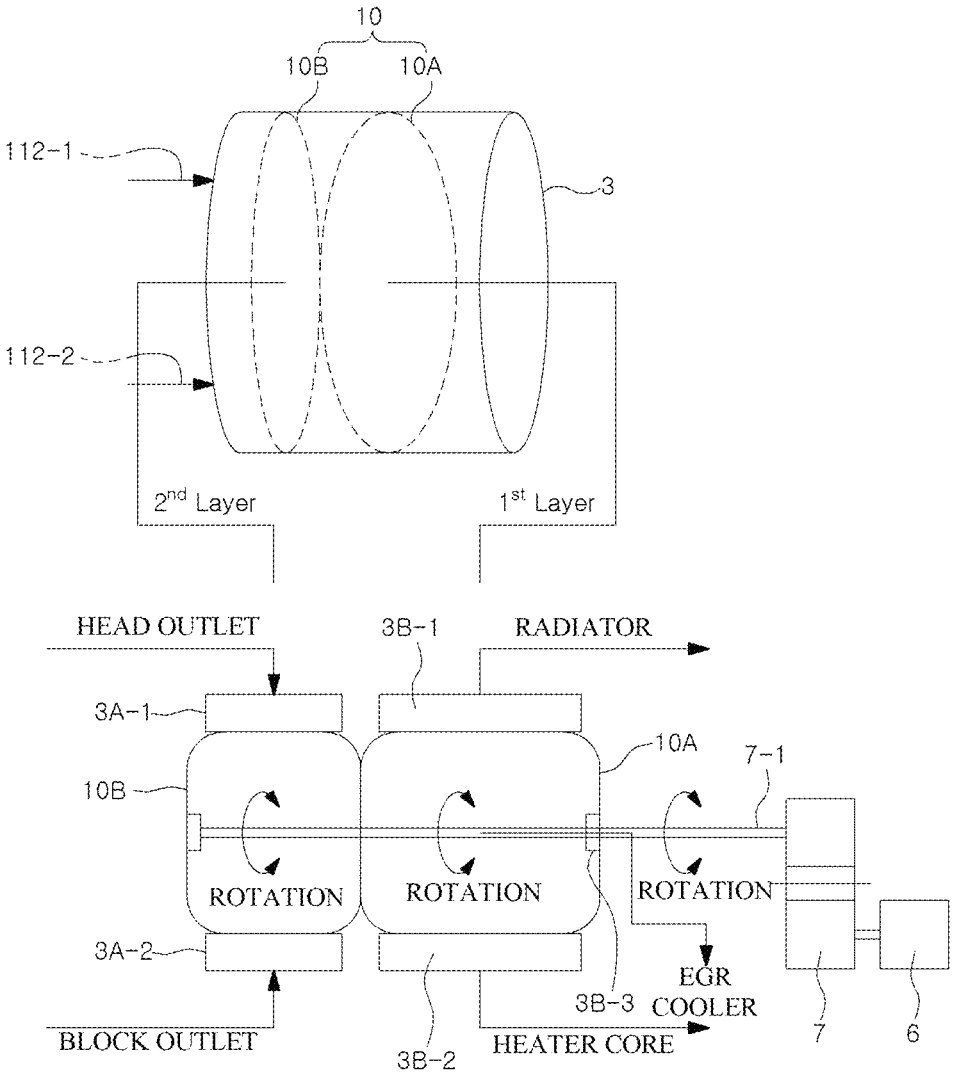
FIG. 2 is a diagram illustrating an example in which a layer ball of the integrated thermal management valve according to the present disclosure constitutes a double layer as first and second layer balls.
Figure 3:
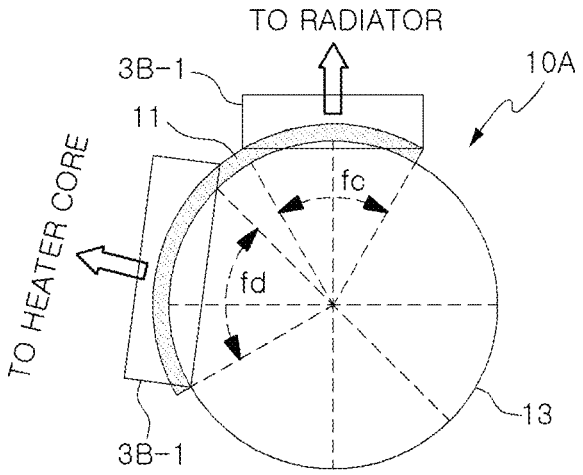
FIG. 3 is a diagram illustrating an example in which the opening/closing of outlet ports of an engine head and an engine block are applied oppositely at the rotation of a coolant outlet flow path of a first layer ball and a second layer ball according to the present disclosure.
Figure 3:
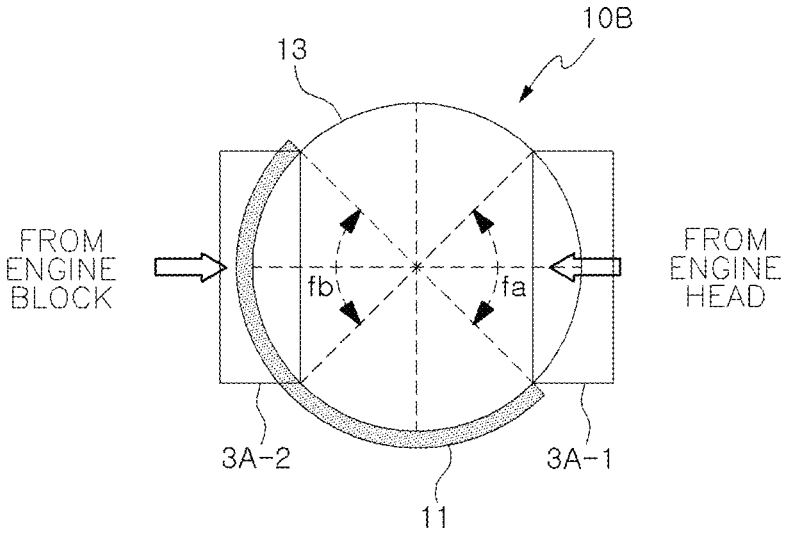

FIGS. 2 and 3 illustrate a detailed configuration of the ITM 1.

Referring to FIG. 2, the ITM 1 performs an engine coolant distribution control and an engine coolant flow stop control according to a variable separation cooling operation by a combination of a first layer ball 10A and a second layer ball 10B constituting the layer ball 10.

Therefore, the ITM 1 may implement the coolant control mode of the vehicle thermal management system 100 under the engine coolant distribution control provided with the priority in the same opening condition of the ITM 1 even while performing all functions implemented by the existing four-port ITM in the three-port configuration of the first and second layer balls 10A, 10B constituting the layer ball 10, and furthermore, is associated with the B, C, D, E, which are the unique operating modes of the SSV 400. Thereby, the heat exchange efficiency together with the fast mode switching are enhanced.

Furthermore, the ITM 1 includes a valve housing 3 accommodating the layer ball 10 and forming three ports and an actuator 5 (shown in FIG. 7) for operating the layer ball 10 under the control of the valve controller 1000.

Specifically, the valve housing 3 forms an inner space in which the layer ball 10 is accommodated and forms three ports through which the engine coolant flows in and out in the inner and outer spaces. The three ports are formed of the coolant inlet 3A forming one inlet direction by one port and the coolant outlet flow path 3B forming three outlet directions (for example, the radiator, the heater core, and the EGR cooler) by two ports.

For example, the coolant inlet 3A includes an engine head coolant inlet 3A-1 connected to the engine head coolant outlet 112-1 of the engine 110 and an engine block coolant inlet 3A-2 connected to the engine block coolant outlet 112-2 of the engine 110. Further, the coolant outlet flow path 3B includes the radiator outlet flow path 3B-1 connected with the first coolant flow path 101 connected to the radiator 300, a heater outlet flow path 3B-2 connected with the second coolant flow path 102 connected to the heater core 200, and an EGR outlet hole 3B-3 connected with the EGR coolant flow path 106 of the EGR cooler 500. In this case, the EGR outlet hole 3B-3 is perforated in the valve housing 3 as a hole.

In particular, the radiator outlet flow path 3B-1 may be formed in a general symmetrical structure for applying a 0-100% variable control unit to partially maintain the 100% opening condition of the radiator to set the switching range of the mode for the variable flow pattern control.

Specifically, the actuator 5 is connected with a speed reducer 7 by applying a motor. In this case, the motor may be a Direct Current (DC) motor or a Step motor controlled by the valve controller 1000. The speed reducer 7 is composed of a motor gear that is rotated by a motor and a valve gear having a gear shaft 7-1 for rotating the layer ball 10.

Therefore, the actuator 5, the speed reducer 7, and the gear shaft 7-1 have the same configuration and operating structure as those of the general ITM 1. However, there is a difference in that the gear shaft 7-1 is configured to rotate the first layer ball 10A and the second layer ball 10B of the layer ball 10 together at operation of the motor 6 to change a valve opening angle.

Referring to FIG. 3, each of the first and second layer balls 10A, 10B is formed by cutting a channel flow path 13 by a certain section of a ball body 11 of the hollow sphere, and the channel flow path 13 is formed at about 180° relative to 360° of the ball body 11. Further, the first layer ball 10A forms the radiator outlet flow path 3B-1 and the heater outlet flow path 3B-2 as ports. The second layer ball 10B forms the opening of the engine head coolant inlet 3A-1 and the engine block coolant inlet 3A-2 oppositely.

In particular, if the channel flow path 13 is completely opened in a head direction section (fa) of the engine head coolant inlet 3A-1 according to the rotational direction of the ball body 11, the channel flow path 13 is completely blocked in a block direction section (fb) of the engine block coolant inlet 3A-2 or is partially opened in the head direction section (fa) and the block direction section (fb) at the same time. Further, the channel flow path 13 forms a radiator section (fc) of the radiator outlet flow path 3B-1 and a heater core section (fd) of the heater outlet flow path 3B-2.

As a result, a path is formed where the coolant flowing into the first and second layer balls 10A, 10B flows out from the first layer ball 10A to the first coolant flow path 101, the second coolant flow path 102, and the EGR coolant flow path 106.

Figure 4:
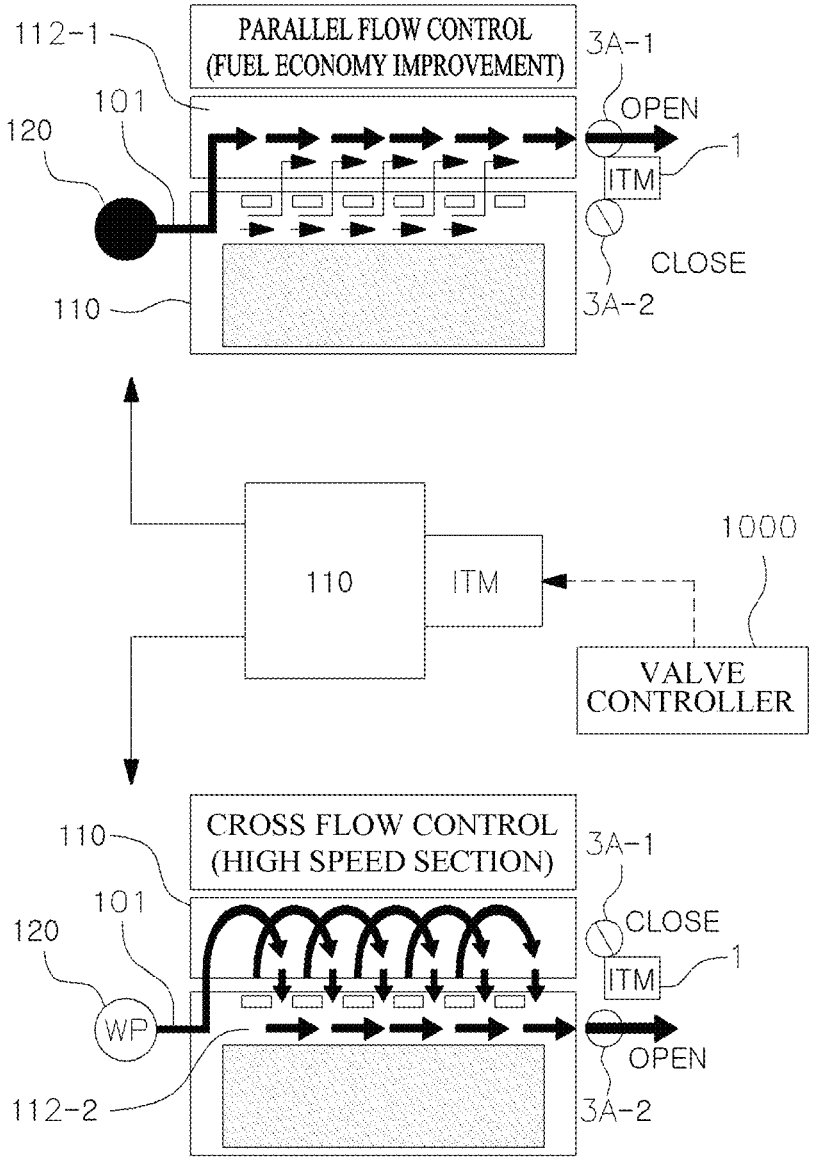
FIG. 4 is a diagram illustrating a state where engine coolant flows out to an ITM while forming a Parallel Flow or a Cross Flow inside an engine by the opposite operation between the outlet ports of the engine head and the engine block according to an example of the present disclosure.

FIG. 4 illustrates an example of a coolant formation pattern of the ITM 1 using the mutual opposite opening or blocking of the engine head coolant inlet 3A-1 and the engine block coolant inlet 3A-2 of the second layer ball 10B. In this case, the coolant formation pattern is classified into a Parallel Flow (Pt) formed in STATES 1 and 4 of the engine coolant control mode, and a Cross Flow (Cf) formed in STATES 2, 3, and 5 of the engine coolant control mode.

For example, the Parallel Flow of coolant opens the engine head coolant inlet 3A-1 to communicate with the engine head coolant outlet 112-1 by 100% while it closes the engine block coolant inlet 3A-2 to be blocked from the engine block coolant outlet 112-2 by 100%, thereby being formed so that the coolant flows out only to the head side inside the engine 110. In this case, the Parallel Flow raises the block temperature of the engine 110, thereby improving fuel efficiency.

For example, the Cross Flow of the coolant opens the engine block coolant inlet 3A-2 to communicate with the engine block coolant outlet 112-2 by 100% while it closes the engine head coolant inlet 3A-1 to be blocked from the engine head coolant outlet 112-1 by 100%, thereby being formed so that the coolant flows out only to the block side inside the engine 110. In this case, the Cross Flow lowers the block temperature of the engine 110, thereby improving knocking and durability.

In particular, the valve opening of the ITM 1 may form a switching range between the Parallel Flow (Pt) and the Cross Flow (Cf). In this case, the switching range maintains the opening of the radiator flow path having the 0 to 100% symmetry setting of the variable control by 100% in a state where the flow path of the heater outlet flow path 3B-2 of the first layer ball 10A has continuously maintained the complete opening, thereby being implemented by a coupling control that forms the simultaneous opening section of the head direction section (fa) and the block direction section (fb) of the second layer ball 10B.

Figure 5:
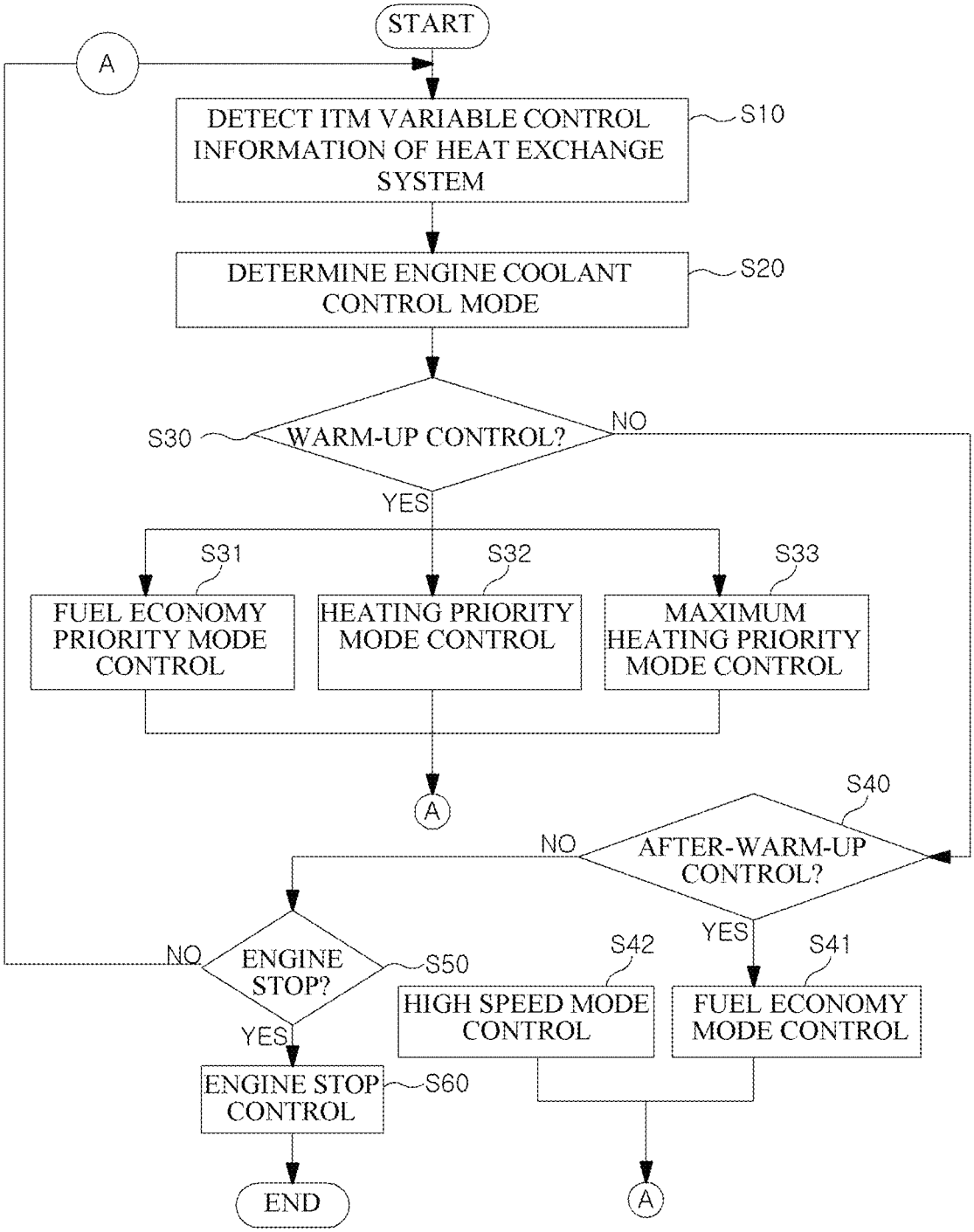
FIG. 5 is an operational flowchart of a cooling circuit control method of a vehicle thermal management system according to an example of the present disclosure.
Figure 6A:
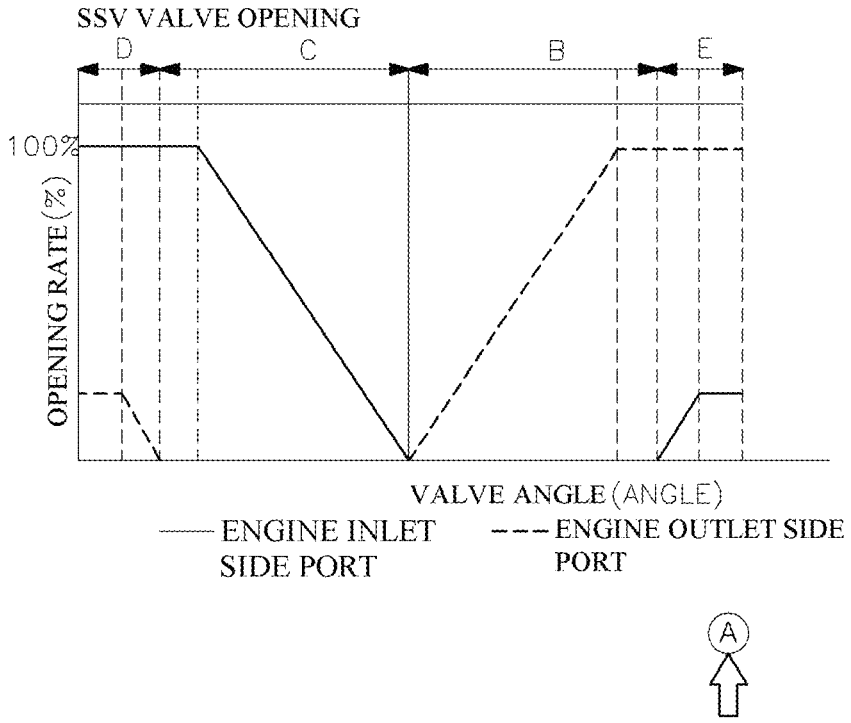
FIGS. 6A and 6B are a diagram illustrating a mutual associated control state of an ITM and an SSV of a valve controller according to STATES 1-7 of an engine coolant control mode according to an example of the present disclosure.
Figure 6B:
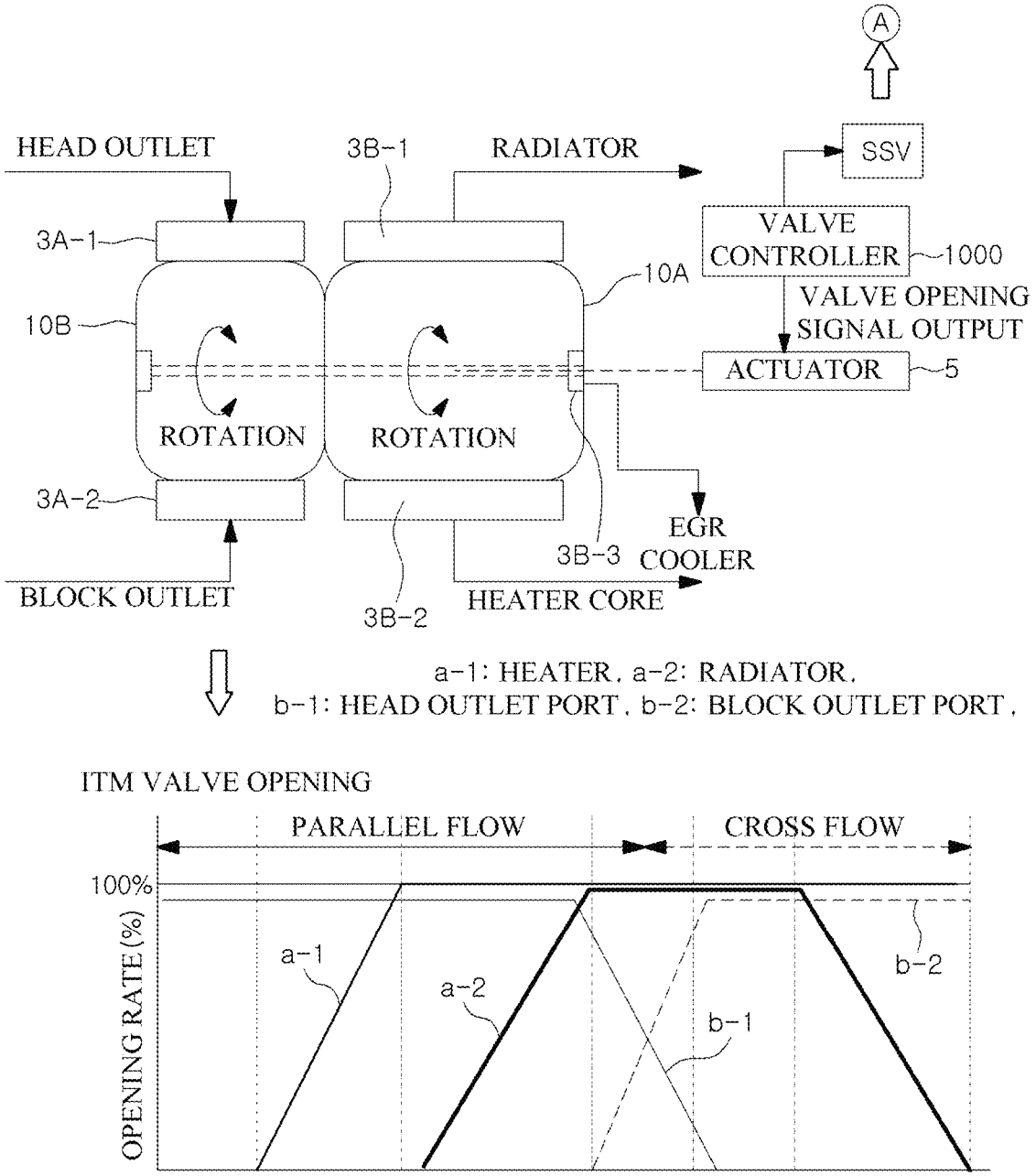

FIGS. 5, 6A and 6B illustrate a variable separation cooling control method of a coolant control mode (for example, STATES 1-5) of the vehicle thermal management system 100 according to an example. In this case, the control subject is the valve controller 1000 and the control target includes the operation of the heat exchange system in which the direction of the valve is controlled based on the ITM 1 and the SSV 400 in which the valve opening is controlled, respectively.

As illustrated, the cooling circuit control method of the vehicle thermal management system applying the ITM 1 performs determining an engine coolant control mode (S20) by detecting the ITM variable control information of the heat exchange system by the valve controller 1000 (S10) and then performs a variable separation cooling valve control (S30-S60). As a result, the control method of the vehicle thermal management system may simultaneously implement the fast warm-up of the engine and the fast warm-up of the engine oil/transmission fluid (ATF). In particular, fuel efficiency and heating performance may be simultaneously improved by shortening the EGR usage time point.

Specifically, the valve controller 1000 performs the detecting of the ITM variable control information of the heat exchange system (S10) by using, as input data, an IG on/off signal, a vehicle speed, an engine load, an engine temperature, a coolant temperature, a transmission fluid temperature, an outside air temperature, an ITM operating signal, accelerator/brake pedal signals, and the like provided by the information inputter 1000-1. In other words, the operating information of the vehicle thermal management system 100, in which the radiator, the EGR cooler, and the heater core are optionally combined by the valve controller 1000, is detected.

Subsequently, the valve controller 1000 matches the valve opening of the ITM 1 with the engine coolant temperature condition by using the ITM map of the variable separation cooling map 1000-2 and at the same time, matches the valve opening of the SSV 400 by using the SSV map with respect to the input data of the information inputter 1000-1, and performs the determining of the engine coolant control mode (S20) therefrom. In this case, the determining of the engine coolant control mode (S20) applies an operating condition, and the operating condition is determined by a vehicle speed, an engine load, an engine temperature, a coolant temperature, a transmission fluid temperature, an outside air temperature, and the like to be determined as a state of the different condition, respectively, according to its value.

As a result, the valve controller 1000 enters the variable separation cooling valve control (S30-S60). For example, the variable separation cooling valve control (S30-S60) is classified into a warm-up control (S30) and an after-warm-up control (S40) in which the mode is switched by applying a transition condition according to the operating condition, and an engine stop control (S50 and S60) according to the engine stop (for example, IG OFF).

Specifically, the valve controller 1000 determines the necessity of the warm-up by applying the warm-up mode (S30) and then enters a fuel efficiency priority mode control (S31) or a heating priority mode control (S32) or a maximum heating priority mode control (S33) with respect to the warm-up control (S30). Further, the valve controller 1000 enters a fuel efficiency mode control (S41) or a high-speed mode control (S42) with respect to the after-warm-up control (S40)

Specifically, the valve controller 1000 determines the engine stop (S50) and then performs an engine stop control (S60). In this case, in the engine stop control (S60), since the engine is in an engine stop (IG off) state, the ITM 1 is switched to a state that is opened by the valve controller 1000 at the maximum cooling position.

Referring to FIGS. 6A and 6B, the operation of each of the fuel efficiency priority mode control (S31), the heating priority mode control (S32), the maximum heating priority mode control (S33), the fuel efficiency mode control (S41), and the high-speed mode control (S42) is described below.

For example, in the fuel efficiency priority mode control (S31), the valve opening of the ITM 1 closes the radiator outlet flow path 3B-1 and the heater outlet flow path 3B-2 while opening the engine head coolant inlet 3A-1 and closing the engine block coolant inlet 3A-2. Further, the valve opening of the SSV 400 is switched to close the coolant branch flow path 107 with respect to both the engine inlet side port and the engine outlet side 400-1 port not to form the engine coolant joining flow from the SSV 400 to the EGR cooler 500 while the EGR cooler 500 forms only a small amount of the engine coolant flow flowing out from the ITM 1 side in the initial opening state of the SSV 400.

Therefore, the fuel efficiency priory mode control (S31), as a STATE 1 that forms the Parallel Flow, stops the flow of the engine coolant flowing through the engine 110 until arriving the flow stop release temperature, thereby raising the engine temperature as quickly as possible. In this case, the transition condition for stopping the fuel efficiency priority mode control (S31) applies the arrival of the engine temperature condition that arrives the flow stop release temperature beyond the cold start due to the rise in the coolant temperature or the high speed/high load condition of the quick acceleration according to the depression of the accelerator pedal.

For example, in the heating priority mode control (S32), the valve opening of the ITM 1 closes the radiator outlet flow path 3B-1 and mostly opens (about 90%) the heater outlet flow path 3B-2 while opening the engine head coolant inlet 3A-1 and partially opening the engine block coolant inlet 3A-2. Further, the valve opening of the SSV 400 is switched to close the coolant branch flow path 107 with respect to the engine inlet side port and opens it with respect to the engine outlet side port, such that the EGR cooler 500 receives the flow rate of the engine coolant from the ITM 1 side by the opening of the engine outlet side port of the SSV 400.

Therefore, the heating priority mode control (S32), as a STATE 2 that forms the Cross Flow, performs the flow rate control of the heater core 200 side (however, the heater control section at the warm-up is used before the heater is turned on). In this case, the transition condition for stopping the heating priority mode control (S32) applies the initial coolant temperature/outside air temperature of a certain temperature or more (i.e., the fuel efficiency priority mode switchable temperature), the coolant temperature threshold or more exceeding the warm-up temperature, and the heater operation (heater on).

For example, in the maximum heating priority mode control (S33), the valve opening of the ITM 1 closes the radiator outlet flow path 3B-1 and completely opens the heater outlet flow path 3B-2 while opening the engine head coolant inlet 3A-1 and partially opening the engine block coolant inlet 3A-2. Further, the valve opening of the SSV 400 is switched to close the coolant branch flow path 107 with respect to both the engine inlet side port and the engine outlet side port, such that the EGR cooler 500 forms only a small amount of the engine coolant flow flowing out from the ITM 1 side in the initial opening state of the SSV 400. In this case, it may perform the partial opening of the engine inlet side port and the engine outlet side port at the same time, if necessary.

Therefore, the maximum heating priority mode control (S33), as a STATE 3 that forms the Cross Flow, adjusts the engine coolant temperature of the engine 110 according to the target coolant temperature. In this case, the transition condition for stopping the maximum heating priority mode control (S33) applies the arrival of the condition of the coolant temperature threshold or more calculated by being matched with the outlet temperature of the radiator 300.

For example, in the fuel efficiency mode control (S41), the valve opening of the ITM 1 partially opens the radiator outlet flow path 3B-1 and opens the heater outlet flow path 3B-2 while opening the engine head coolant inlet 3A-1 and closing the engine block coolant inlet 3A-2. Further, the valve opening of the SSV 400 is switched to open the coolant branch flow path 107 with respect to the engine inlet side port while closing it with respect to the engine outlet side port, such that the coolant flowing out from the water pump outlet end is branched at the engine inlet side to be joined to the flow rate of the coolant through the SSV 400 in the EGR cooler 500.

Therefore, the fuel efficiency mode control (S41), as a STATE 4 that forms the Parallel Flow, reduces the flow rate of the engine coolant of the heater core 200 required for the cooling/heating control to a minimum flow rate, thereby maximally securing the cooling capability in the high load condition and the uphill condition. In this case, the transition condition for stopping the fuel efficiency mode control (S41) applies the arrival of the condition in which the engine coolant temperature of about 110° C. to 115° C. or more is set to a coolant temperature threshold.

For example, in the high speed mode control (S42), the valve opening of the ITM 1 completely opens the radiator outlet flow path 3B-1 and the heater outlet flow path 3B-2 while blocking the engine head coolant inlet 3A-1 and opening the engine block coolant inlet 3A-2. Further, the valve opening of the SSV 400 is switched to open the coolant branch flow path 107 with respect to the engine inlet side port while closing it with respect to the engine outlet side port, such that the coolant flowing out from the water pump outlet end is branched at the engine inlet side to be joined to the flow rate of the coolant through the SSV 400 in the EGR cooler 500.

Therefore, the high-speed mode control (S42), as a STATE 5 that forms the Cross Flow, performs a block temperature downward control with respect to the block of the engine 110. In this case, the transition condition for stopping the high-speed mode control (S42) applies the arrival of the condition of the high speed/high load operating data (for example, the result value matched with the variable separation cooling map 1000-2) and the coolant temperature threshold or more. However, practically, it is appropriately limited to frequently change from the STATE 5 state to other coolant control modes by applying the hysteresis and/or the response delay time of the ITM 1. In this example, the coolant temperature threshold is set to a value exceeding the warm-up temperature.

As described above, the vehicle thermal management system 100 according to the present embodiment forms the engine coolant flow circulating the engine 110 optionally via the heater core 200 and the radiator 300, and joins a relatively large amount of the flow rate of the coolant to shorten the EGR usage time point to be advantageous for improving fuel efficiency by adding the coolant required for improving the EGR condensate problem to the SSV 400 through the ITM layout while increasing the completeness of the initial design engine with the optimal cooling concept of the ITM 1 in association with the ITM 1 and the SSV 400. Thereby, the fast warm-up and the heating performance of the engine are improved.

What is claimed is:

1. A vehicle thermal management system, comprising:

an Integrated Thermal Management Valve (ITM) for receiving engine coolant through a coolant inlet connected to an engine coolant outlet of an engine, and distributing the engine coolant flowing out toward a radiator through a coolant outlet flow path connected to a heater core and a radiator;

a water pump positioned at the front end of an engine coolant inlet of the engine;

a coolant branch flow path branched at the front end of the engine coolant inlet to be connected with an Exhaust Gas Recirculation (EGR) cooler; and a Smart Single Valve (SSV) for adjusting an engine coolant flow in the EGR cooler flow path direction on the coolant branch flow path.

2. The vehicle thermal management system of claim 1, wherein the coolant outlet flow path comprises a radiator outlet flow path connected to the radiator, a heater outlet flow path connected to the heater core, and an EGR outlet hole connected to the EGR cooler connected with the coolant branch flow path.

3. The vehicle thermal management system of claim 1, wherein the engine coolant outlet comprises an engine head coolant outlet and an engine block coolant outlet, and the coolant inlet comprises an engine head coolant inlet connected with the engine head coolant outlet and an engine block coolant inlet connected with the engine block coolant outlet.

4. The vehicle thermal management system of claim 3, wherein the valve opening of the ITM forms the opening or closing of the engine head coolant inlet and the engine block coolant inlet oppositely.

5. The vehicle thermal management system of claim 4, wherein the opening of the engine head coolant inlet forms a Parallel Flow, in which the coolant flows out to the engine head coolant outlet, inside an engine, and the opening of the engine block coolant inlet forms a Cross Flow in which the coolant flows out to the engine block coolant outlet, inside the engine.

6. A cooling circuit control method of a vehicle thermal management system, comprising:

distributing the coolant flowing out toward a heater core and a radiator by flowing the engine coolant circulated to a water pump and the radiator from an Integrated Thermal Management Valve (ITM) into an engine;

adjusting a coolant flow on the coolant branch flow path branched at the front end of the engine coolant inlet to be connected with an Exhaust Gas Recirculation (EGR) cooler by a Smart Single Valve (SSV);

distributing the coolant by switching the outlet flow path of the coolant outlet flow path connected to the heater core to the ITM, and adjusting the coolant flow by switching the coolant branch flow path connected to an EGR outlet hole of the coolant outlet flow path connected to the EGR cooler to the SSV; and performing any one among a STATE 1, a STATE 2, a STATE 3, a STATE 4, and a STATE 5 as an engine coolant control mode of a vehicle thermal management system under a valve opening control of the ITM and the SSV by a valve controller.

7. The cooling circuit control method of the vehicle thermal management system of claim 6, wherein in the STATE 1, the ITM opens the engine head coolant inlet while it closes the engine block coolant inlet, the radiator outlet flow path, and the heater outlet flow path, and the SSV closes the coolant branch flow path with respect to both an engine inlet and an engine outlet.

8. The cooling circuit control method of the vehicle thermal management system of claim 6, wherein in the STATE 2, the ITM opens the heater outlet flow path while opening the engine head coolant inlet while it closes the radiator outlet flow path while partially opening the engine block coolant inlet, and the SSV opens the coolant branch flow path with respect to an engine outlet while closing it with respect to an engine inlet.

9. The cooling circuit control method of the vehicle thermal management system of claim 6, wherein in the STATE 3, the ITM opens the engine head coolant inlet and the heater outlet flow path while it closes the radiator outlet flow path while partially opening the engine block coolant inlet, and the SSV closes the coolant branch flow path with respect to both an engine inlet and an engine outlet.

10. The cooling circuit control method of the vehicle thermal management system of claim 6, wherein in the STATE 4, the ITM opens the engine head coolant inlet and the heater outlet flow path while it partially opens the radiator outlet flow path while closing the engine block coolant inlet, and the SSV opens the coolant branch flow path with respect to an engine inlet while closing it with respect to an engine outlet.

11. The cooling circuit control method of the vehicle thermal management system of claim 6, wherein in the STATE 5, the ITM opens the engine block coolant inlet, the radiator outlet flow path, and the heater outlet flow path while it closes the engine head coolant inlet, and the SSV opens the coolant branch flow path with respect to an engine inlet while closing it with respect to an engine outlet.

12. The cooling circuit control method of the vehicle thermal management system of claim 6, wherein the controlling of each of the STATE 1, the STATE 2, the STATE 3, the STATE 4, and the STATE 5 is determined by the operating condition of the vehicle operating information.

13. The cooling circuit control method of the vehicle thermal management system of claim 6, wherein the valve controller is switched to an engine coolant control mode that opens the valve opening of the ITM to a maximum cooling position at the engine stop.

* * * * *